US010720712B2

(12) United States Patent
Foo

(10) Patent No.: US 10,720,712 B2
(45) Date of Patent: Jul. 21, 2020

(54) LIQUID-CRYSTAL TUNABLE METASURFACE FOR BEAM STEERING ANTENNAS

(71) Applicant: Senglee Foo, Ottawa (CA)

(72) Inventor: Senglee Foo, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 319 days.

(21) Appl. No.: 15/630,456

(22) Filed: Jun. 22, 2017

(65) Prior Publication Data

US 2018/0083364 A1 Mar. 22, 2018

Related U.S. Application Data

(60) Provisional application No. 62/398,141, filed on Sep. 22, 2016.

(51) Int. Cl.
*H01Q 15/14* (2006.01)
*H01Q 15/00* (2006.01)
(Continued)

(52) U.S. Cl.
CPC ..... *H01Q 15/148* (2013.01); *H01Q 1/364* (2013.01); *H01Q 3/30* (2013.01); *H01Q 15/002* (2013.01);
(Continued)

(58) Field of Classification Search
CPC ..... H01Q 15/148
(Continued)

(56) References Cited

U.S. PATENT DOCUMENTS 6,552,696 B1 * 4/2003 Sievenpiper ..... H01Q 3/44 343/700 MS
6,919,862 B2 * 7/2005 Hacker ..... H01P 1/2005 333/248
(Continued)

FOREIGN PATENT DOCUMENTS

CN 102751586 A 10/2012
CN 103560324 A 2/2014
(Continued)

OTHER PUBLICATIONS

Hu et al. ("Design and Measurement of Reconfigurable Millimeter Wave Reflectarray Cells With Nematic Liquid Crystal", IEE transaction on antennas and propagation, vol. 56. No. 10, Oct. 2008).*
(Continued)

*Primary Examiner* — Timothy A Brainard
*Assistant Examiner* — Nuzhat Pervin

(57) ABSTRACT

An electronically tunable metasurface whose reflective phase can be electronically reconfigured to allow effective antenna beam steering. First and second double sided substrates define an intermediate region between them containing liquid crystal in a nematic phase. A first microstrip patch array of the first substrate and a second microstrip patch array of the second substrate are aligned to form a two dimensional array of cells, Each cell comprises a microstrip patch of the first microstrip patch array arranged in spaced apart opposition to a microstrip patch of the second microstrip patch array with a volume of the liquid crystal located therebetween. Each control terminal to the microstrip patch of the second array permits a control voltage to be applied to the cell to control a dielectric value of the volume of the liquid crystal, thereby permitting a reflection phase of the cell to be selectively tuned.

16 Claims, 6 Drawing Sheets

(51) Int. Cl.
*H01Q 1/36* (2006.01)
*H01Q 3/30* (2006.01)

(52) U.S. Cl.
CPC ..... *H01Q 15/004* (2013.01); *H01Q 15/0026* (2013.01)

(58) Field of Classification Search
USPC ..... 342/6
See application file for complete search history.

(56) References Cited

U.S. PATENT DOCUMENTS 7,173,565 B2 * 2/2007 Sievenpiper ..... H01Q 15/24 343/700 MS
7,236,142 B2 * 6/2007 Amyotte ..... H01Q 1/1207 343/756
7,466,269 B2 * 12/2008 Haziza ..... H01Q 3/36 343/700 MS
7,586,444 B2 * 9/2009 Berlin ..... H01Q 15/0026 343/700 MS
7,868,829 B1 * 1/2011 Colburn ..... H01Q 3/46 343/700 MS
7,884,766 B2 * 2/2011 Haziza ..... H01Q 3/36 343/700 MS
8,134,521 B2 * 3/2012 Herz ..... H01Q 15/14 343/700 MS
8,836,569 B1 * 9/2014 James ..... H01Q 15/14 342/3
9,385,435 B2 * 7/2016 Bily ..... H01Q 13/22
9,450,310 B2 * 9/2016 Bily ..... H01Q 15/02
9,553,364 B2 * 1/2017 Williams ..... H01Q 3/446
9,976,081 B2 * 5/2018 Zheng ..... C09K 19/0275
10,090,599 B2 * 10/2018 Bily ..... H01Q 13/22
10,320,089 B2 * 6/2019 Jakoby ..... H01Q 3/44
2004/0066340 A1 4/2004 Hacker et al.
2007/0257853 A1 11/2007 Gevorgian et al.
2009/0091500 A1 * 4/2009 Haziza ..... H01Q 3/36 343/700 MS
2014/0266897 A1 * 9/2014 Jakoby ..... H01Q 3/44 342/368
2015/0062691 A1 3/2015 Sayyah et al.
2015/0162658 A1 * 6/2015 Bowers ..... H01Q 15/006 342/385
2015/0171516 A1 * 6/2015 Chen ..... H01Q 3/00 342/368
2015/0180120 A1 * 6/2015 Pietraski ..... H01Q 15/0086 342/368
2016/0103283 A1 * 4/2016 Meade ..... G02B 6/30 385/14
2019/0020107 A1 * 1/2019 Polehn ..... H01Q 9/045

FOREIGN PATENT DOCUMENTS

EP 2020051 B1 * 9/2016 ..... H01Q 3/36
JP 2000341027 A 12/2000
JP 2003529259 A 9/2003
JP 2007522735 A 8/2007
JP 2009538565 A 11/2009
JP 2014531843 A 11/2014
WO WO-2007122409 A1 * 11/2007 ..... H01P 1/19
WO WO-2012080532 A1 * 6/2012 ..... G02F 1/1347
WO WO-2013045267 A1 * 4/2013 ..... H01Q 1/44

OTHER PUBLICATIONS

Wenfei Hu et al. Design and Measurement of Reconfigurable Millimeter Wave Reflectarray Cells With Nematic Liquid Crystal, IEEE Transactions on Antennas and Propagation, vol. 56, No. 10, Oct. 2008. pp. 3112-3117. XP11235406A.

A. Couch et al. A Phase-tunable, Liquid Crystal-based Metasurface, 10th International Congress on Advanced Electromagnetic Materials in Microwaves and Optics—Metamaterials, Crete, Greece, Sep. 17-22, 2016, pp. 94-96, XP33009916A.

Senglee Foo, Liquid-crystal-tunable metasurface antennas, 2017 11th European Conference on Antennas and Propagation (EUCAP). 2017 IEEE. pp. 3026-3028.

W. Hu et al. Phase control of reflectarray patches using liquid crystal substrate, Proc. 'EuCAP 2006', Nov. 6-10, 2006. total 6 pages.

D.F. Sievenpiper, J.H. Schaffner, H.J. Song, R.Y. Loo, and G. Tangonan, "Two-Dimensional Beam Steering Using an Electrically Tunable Impedance Surface," IEEE Transactions on Antennas and Propagation, vol. 51, No. 10, pp. 2713-2722, Oct. 2003.

Dimitrios C. Zografopoulos et al. Tunable terahertz fishnet metamaterials based on thin nematic liquid crystal layers forfast switching, Scientific Reports, Published: Aug. 14, 2015, pp. 1-11.

* cited by examiner

LIQUID-CRYSTAL TUNABLE METASURFACE FOR BEAM STEERING ANTENNAS

RELATED APPLICATIONS

This application claims priority to and benefit of U.S. Provisional Patent Application No. 62/398,141, filed Sep. 22, 2016, the contents of which are incorporated herein by reference.

FIELD

The present disclosure relates to antennas. In particular, the present disclosure relates to a liquid-crystal tunable metasurface for beam steering antennas.

BACKGROUND

Signal strength in an antenna system is dependent on a number of factors, such as distance from the receiver to the transmitter, obstacles between the transmitter and receiver, signal fading, multipath reception, line of sight interference, Fresnel zone interference, radio frequency (RF) interference, weather conditions, noise, etc. Any one, or a combination, of these factors may result in poor connections, dropped connections, low data rates, high latency, etc. In order to mitigate these factors, a lobe of a radiation pattern for the transmitter antenna and/or the receiver antenna may be adjusted to direct the lobe between the receiver and the transmitter. Adaptive beam formers or beam steering automatically adapts the antenna response (of the transmitter, receiver, or both) to compensate for signal loss. In beam formers, interfering and constructing patterns may be used to change the shape and direction of the signal beam from multiple antennas using antenna spacing and the phase of signal emission from each antenna in an antenna array. Beam steering may change the directionality of the main lobe by controlling the phase and relative amplitude of the signal at each transmitter.

A metasurface, which is an artificial sheet material having electromagnetic properties that can varied on demand, may control reflection and transmission characteristics of EM wave. For example, a metasurface can be a two-dimensional periodical structure that contains electrically small scatterers with periodicity relatively small compared to an operating wavelength. A metasurface for purposes of beam steering system is described in "*Two-Dimensional Beam Steering Using an Electrically Tunable Impedance Surface*" by Sievenpiper et al. (IEEE Trans. On Antennas and Prop., Vol. 51, No. 10, pp 2713-2721, October, 2003). Sievenpiper discloses a two-dimensioning beam steering using an electrically tunable impedance surface loaded using varactor diodes. The use of varactor diode loading becomes impractical for high frequencies with a large surface where over hundreds of diodes are required. For communications applications, use of varactor diodes may be undesirable due to its nonlinearity which can induce undesirable noise due to passive intermodulation (PIM).

SUMMARY

Example embodiments are described of an electronically tunable metasurface whose reflective phase can be electronically reconfigured to allow effective antenna beam steering.

According to one example aspect is a metasurface for reflecting an incident wave to effect beam steering. The metasurface includes first and second double sided substrates defining an intermediate region between them containing liquid crystal in a nematic phase. The first substrate has a first microstrip patch array formed on a side thereof that faces the second substrate, the first microstrip patch array comprising a two-dimensional array of microstrip patches each being electrically connected to a common potential. The second double sided substrate has a second microstrip patch array formed on a side thereof that faces the first substrate, the second microstrip patch array comprising a two-dimensional array of microstrip patches each having a respective conductive terminal. The first microstrip patch array and the second microstrip patch array are aligned to form a two dimensional array of cells, each cell comprising a microstrip patch of the first microstrip patch array arranged in spaced apart opposition to a microstrip patch of the second microstrip patch array with a volume of the liquid crystal located therebetween. The conductive terminal to the microstrip patch of the microstrip patch second array permitting a control voltage to be applied to the cell to control a dielectric value of the volume of the liquid crystal, thereby permitting a reflection phase of the cell to be selectively tuned.

The metasurface may include a gridded wire mesh on the first substrate, each of the microstrip patches of the first microstrip patch array being electrically connected to a respective point of the gridded wire mesh to provide the common potential. The gridded wire mesh may be formed on a side of the first substrate that is opposite the side on which the first microstrip patch array is formed, each of the microstrip patches of the first microstrip patch array being electrically connected to the gridded wire mesh by a respective plated through hole that extends through the first substrate. The respective conductive terminals that extend through the second substrate may also each be plated through holes.

In some configurations, a thickness of the first substrate and a thickness of the intermediate region containing the liquid crystal are each less than ¼ of an intended minimum operating wavelength of the incident wave.

According to another aspect is a metasurface for reflecting an incident wave to effect beam steering. The metasurface includes a wire mesh layer; a ground plane layer generally parallel to the wire mesh layer; and a plurality of cells between the wire mesh layer and the ground plane, each cell comprising a pair of microstrip patches having layer of nematic liquid crystal therebetween.

According to another aspect is a method of beam steering. The method includes providing a metasurface to reflect an incident wave from an antenna, the metasurface comprising a two dimensional array of cells each including a volume of liquid crystal; applying voltages to control terminals associated with a plurality of the cells of the metasurface, the voltage orienting molecules of a liquid crystal within each cell; and adjusting the phase of the incident wave by adjusting a resonant frequency of each cell by varying the orientation of the molecules.

Providing a metasurface can include: providing a first printed circuit board (PCB) having an intermediate substrate layer with a first two dimensional array of microstrip patches formed on one side of the substrate layer and a gridded wire mesh formed on an opposite side of the substrate layer, each of the microstrip patches of the first two dimensional array be electrically connected to a respective point on the wire mesh by a conductor extending through the intermediate substrate layer; providing a second PCB having an intermediate substrate layer with a second two dimensional array of microstrip patches formed on one side of the substrate layer, each of the microstrip patches of the second two dimensional array having a respective conductive control terminal that extends through the second substrate; and arranging the first PCB and the second PCB with a layer of nematic state liquid crystal therebetween such that the microstrip patches of the first two dimensional array each align with a respective microstrip patch of the second two dimensional array to form the two dimensional array of cells.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

An electronically tunable metasurface 100 is shown in FIGS. 1 to 5 according to example embodiments. The metasurface 100 is a liquid-crystal-loaded tunable sheet providing a reflective phase that can be electronically reconfigured to allow effective antenna beam steering. The metasurface 100 is a high-impedance surface and includes an upper surface or side 102 (shown in FIG. 1), a bottom surface or side 104 (shown in FIG. 2), and includes an array of addressable cells 106 for reflective beam steering antenna applications. In an example embodiment, the cells 106 are arranged to provide a two-dimensional periodical structure implementing an array of electrically small scatterers. The dimensions of the cells 106 are selected such that the periodicity of the cell array is relatively small compared to the operating wavelength of the radio waves that the metasurface 100 is intended to reflect. In some examples, the cells have a periodicity that is less than a quarter of the minimum intended operating wavelength.

Figure 1:
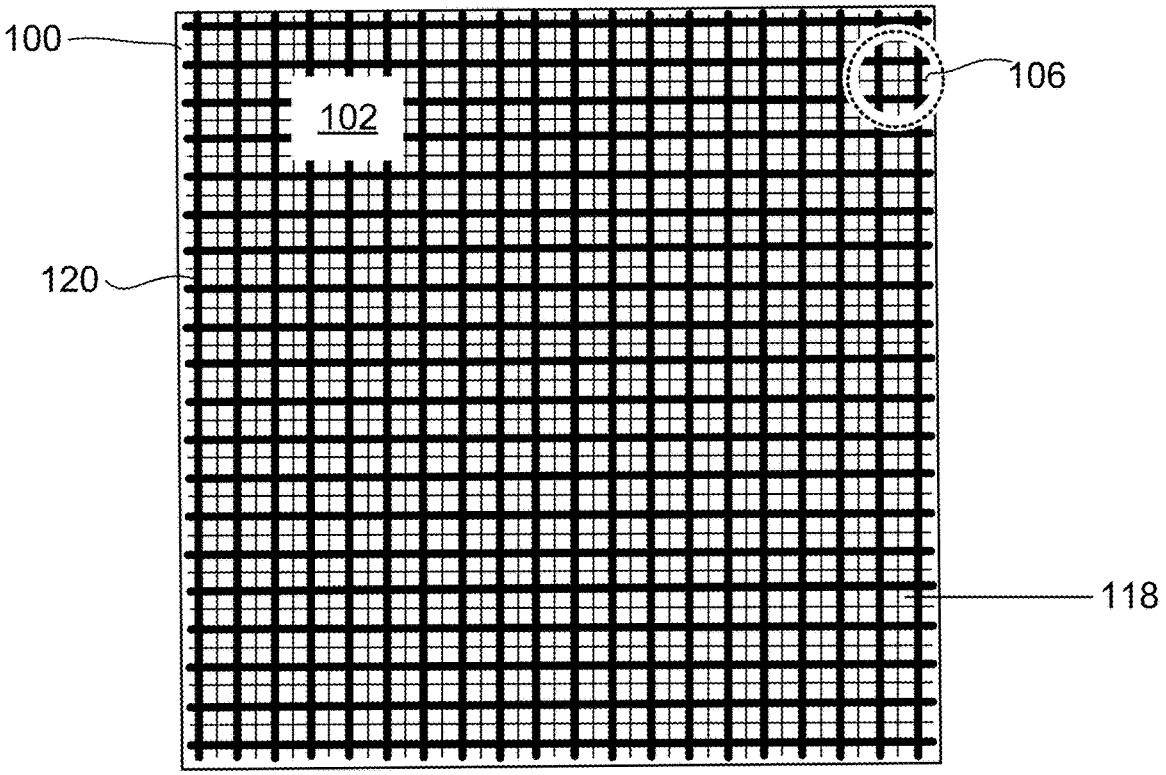
FIG. 1 is a top plan view of a liquid crystal tunable metasurface.
Figure 2:
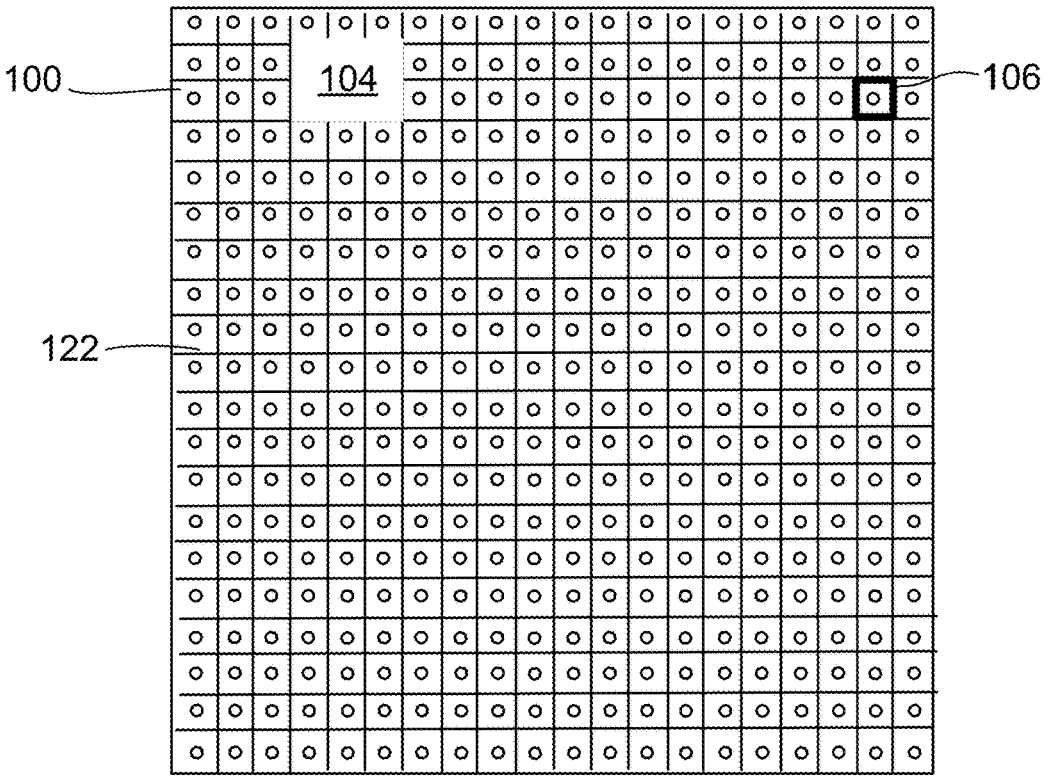
FIG. 2 is a bottom plan view of the liquid crystal tunable metasurface of FIG. 1.
Figure 3:
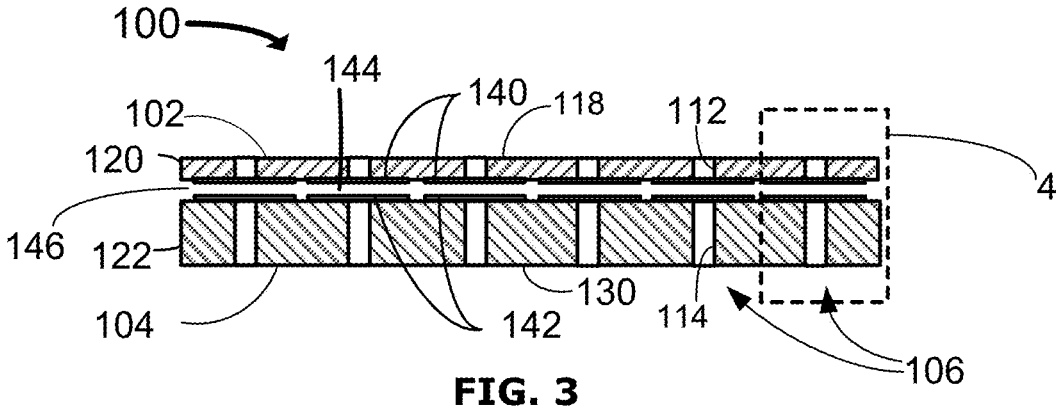
FIG. 3 is a side cross-section view of the liquid crystal tunable metasurface of FIG. 1.
Figure 4:
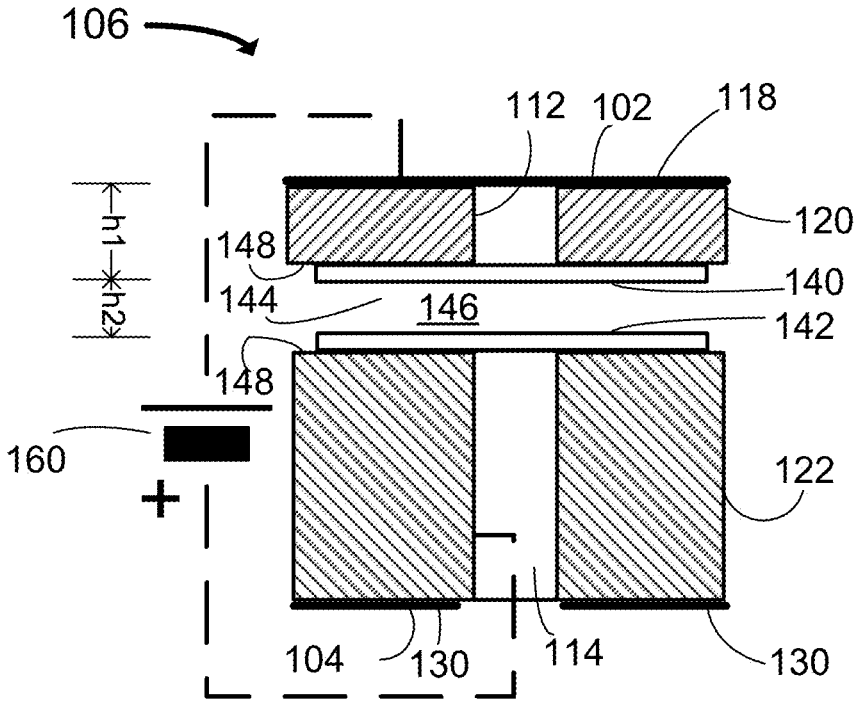
FIG. 4 is a side cross-section view of a unit cell of the liquid crystal tunable metasurface of FIG. 4.

A physical implementation of metasurface 100 will now be described according to example embodiments. FIG. 3 illustrates a side sectional view of a row of cells 106 of metasurface 100, and FIG. 4 shows an enlarged side sectional view of one of the cells 106 as indicated by dashed box 4 in FIG. 3. In the illustrated embodiment, the metasurface 100 includes an upper multi-layer double-sided printed circuit board (PCB) 120 and a lower multi-layer double sided PCB 122, which respectively define the upper and bottom sides 102, 104. A sub-operating wavelength layer of electronically tunable liquid crystal (LC) 146 is located between the upper and lower PCBs 120,122.

Figure 5:
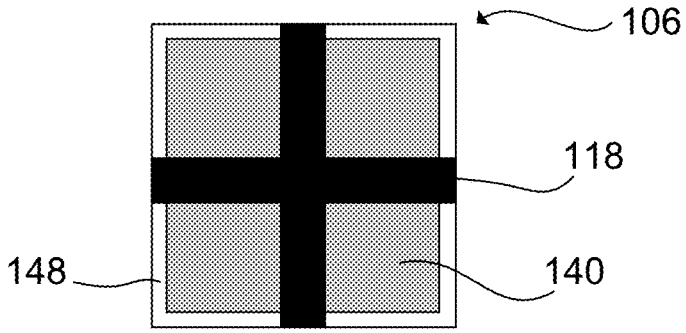
FIG. 5 is a top plan view of selected elements of a unit cell of the liquid crystal tunable metasurface of FIG. 1.

Upper PCB 120 has a central non-conductive substrate layer (shown in cross-hatch in FIGS. 3 and 4). A gridded wire mesh 118 forms the top layer of the PCB 120, and a two dimensional array of conductive microstrip patches 140, each of which is surrounded by an insulating slot or gap 148, forms the bottom layer of the PCB 120. In the illustrated embodiment each microstrip patch 140 is electrically connected by a conductive plated-through hole (PTH) via 112 that extends from the center of the patch 140 through the PCB 120 substrate layer to a respective intersection point of wire mesh 118 such that wire mesh 118 provides a common DC return path for each of the microstrip patches 140. FIG. 5 shows a top view of the wire mesh 118 and microstrip patch 140 layers of a single cell 106 (the substrate layer of PCB 120 is not shown in FIG. 5). In example embodiments, PTH vias 112 may be provided by forming and plating holes through the PCB 120 substrate layer, microstrip patches 140 may be formed from etching gaps 148 from a conductive layer on the lower surface of PCB 120, and gridded wire mesh 118 may be similarly formed by etching a conductive layer on the upper layer of PCB 120.

Lower PCB 122 has a central non-conductive substrate layer (shown in cross-hatch in FIGS. 3 and 4). A two dimensional array of conductive microstrip patches 142, which are each surrounded by an insulating slot or gap 148 and correspond in shape and periodicity to the upper PCB microstrip patches 140, form the top layer of lower PCB 122, and a conductive ground plane 130 forms the bottom layer of PCB 122. Each microstrip patch 142 is electrically connected to a respective conductive plated-through hole (PTH) via 114 that extends from the center of the patch 142 through the PCB 122 substrate layer to the ground plane 130 layer. The ground plane 130 includes an array of openings on the substrate layer that form a circular gap between the ground plane and the PTH vias 114 such that the ground plane 130 is electrically isolated from each of the PTH vias 114, permitting a unique control voltage to be applied to each PTH via 114. In example embodiments, PTH vias 114 may be provided by forming and plating holes through the PCB 122 substrate layer, microstrip patches 142 may be formed from etching gaps 148 from a conductive layer on the upper surface of PCB 120, and ground plane 130 may be similarly formed by etching a conductive layer on the lower layer of PCB 120 to provide insulated openings around each of the PTH vias 114.

In the example embodiment described above, control voltages are provided to the lower microstrip patches 142 through PTH vias 114 that are accessible through the ground plane 130. Other embodiments could have different configurations, including a control line layer that could be integrated into substrate 122 to provide conductive control terminals to each of the microstrip patches 142.

As described above, the upper and lower PCBs 120, 122 are located in spaced opposition to each other with an intermediate layer of liquid crystal 146 located between them. The upper PCB microstrip patches 140 and the lower PCB microstrip patches 142 align with each other to from an array of cell regions 144, each of which contains a volume of liquid crystal 146, thus providing an array of individually controllable, LC cell regions 144.

Accordingly, as can be appreciated from FIG. 4, each unit cell 106 includes a volume of tunable liquid crystal 146 that is located in region 144 between an upper conductive microstrip patch 140 and a lower conductive microstrip patch 142. Upper conductive microstrip patch 140 is connected by a respective conductive path (PTH via 112) to a common potential, namely wire mesh 118, and lower conductive microstrip patch 142 is connected to a control terminal (PTH via 114) that allows a unique control voltage from an adjustable DC voltage source 160 to be applied to the microstrip patch 142

The metasurface 100 has a resonant frequency that can depend on the geometry of the cells 106 and dielectric properties of the materials used in the PCBs 120, 122. In example embodiments, the microstrip patches 140, 142 have rectangular surfaces (for example square) having a maximum normal dimension that is less than ¼ of the minimum intended operating wavelength, however other microstrip patch configurations could be used. In example embodiments, the microstrip patches 140, 142 may have dimensions that are less than quarter of a wavelength of the intended operating wavelength of the metasurface 100. In an example embodiment, wire mesh 118 has a periodicity and grid dimensions that correspond to those of microstrip patches 140, with a grid intersection point occurring over a center point of each microstrip patch 140.

As noted above, in at least some examples, the metasurface 100 illustrated in FIGS. 1 to 5 provides a structure in which etching can be used to form the components of PCB boards 120, 122. During assembly, liquid crystal 146 is can be placed between the PCB's 120, 122, which can then be secured together.

In example embodiments, the liquid crystal 146 is a nematic liquid crystal that has an intermediate nematic gel-like state between solid crystalline and liquid phase at the intended operating temperature range of the metasurface 100. Examples of liquid crystal include, for example, GT3-23001 liquid crystal and BL038 liquid crystal from the Merck group. Liquid crystal 146 in a nematic state possesses dielectric anisotropy characteristics at microwave frequencies, whose effective dielectric constant may be adjusted by setting different orientations of the molecules of liquid crystal 146 relative to its reference axis.

Figure 6:
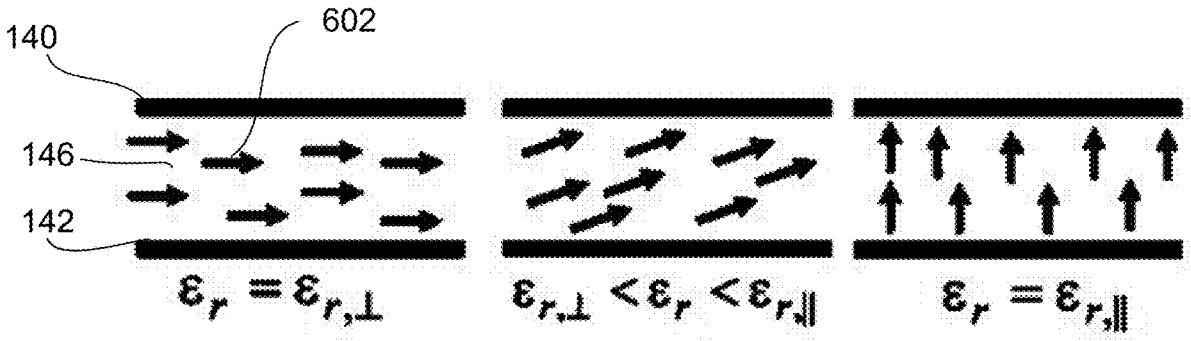
FIG. 6 is a diagram illustrating general anisotropic characteristics of a nematic liquid crystal.

In particular, with reference to FIG. 6, liquid crystal 146 comprises rod-like molecules 602 that orient parallel to an applied electric field $\varepsilon_r$. At microwave frequencies, the liquid crystal 146 may change its dielectric properties due to different orientations of the molecules 602 caused by application of electrostatic field between the microstrip patches 140 and 142 as represented in the three images of FIG. 6. Thus, the dielectric constant between the microstrip patches 140 and 142 at each unit cell 106 can be tuned by varying the DC voltage applied to patch 142. The reflection phase at each individual unit cell 106 to be controlled. The unit cells 106 can be collectively controlled so that metasurface 100 acts like a distributed spatial phase shifter that interacts with an incident wave and produces a reflected wave with varying phase shift across its aperture. An incident beam may be electronically steered to any 2D direction by changing the local electrostatic fields at each unit cell 106 location.

In summary, the resonant frequency of each unit cell 106 may be tuned individually and electronically by adjusting DC voltage at each cell 106. Because reflection phase is determined by the frequency of the incoming wave with respect to the resonance frequency, the metasurface 100 can be tuned to form a distributed 2D phase shifter. Therefore, an incoming wave may be redirected by adjusting DC voltages of unit cells 106 to give proper phase distribution for the desired direction of reflected wave.

Figure 7:
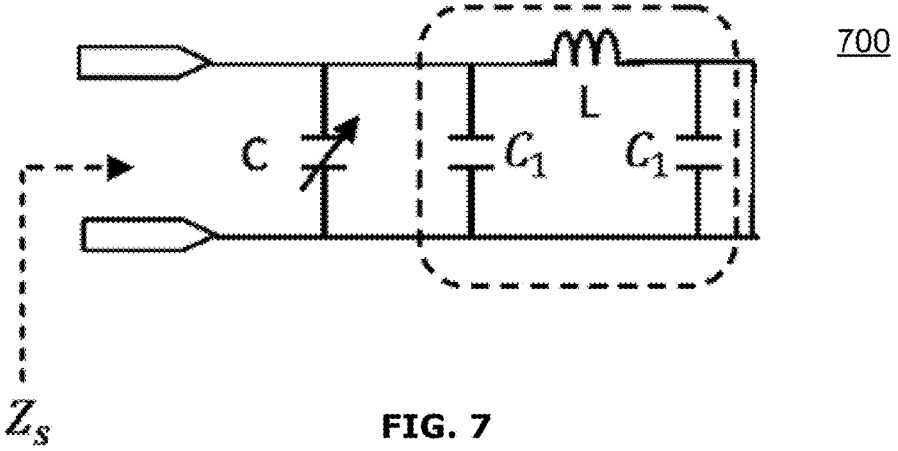
FIG. 7 is a schematic of an equivalent circuit of the unit cell of the liquid crystal tunable metasurface.
Figure 8:
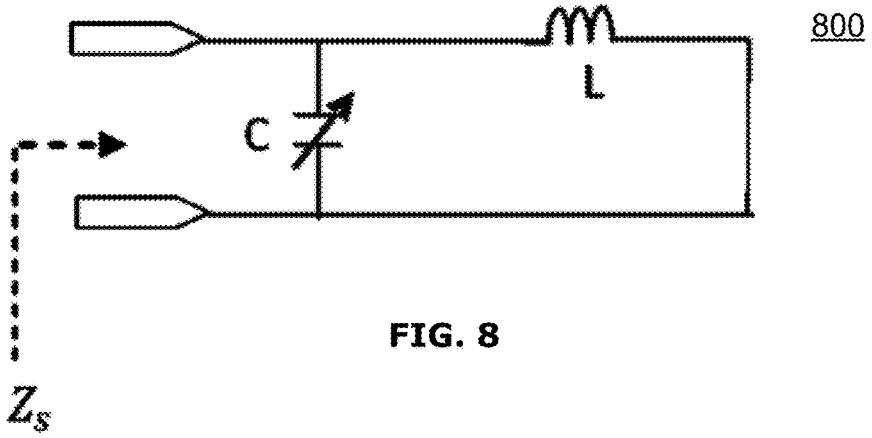
FIG. 8 is a schematic of a further equivalent circuit of the unit cell of the liquid crystal tunable metasurface.

In example embodiments the metasurface 100 has a relatively high density/small periodicity of cells 106 and can be analyzed as an effective medium with its surface impedance defined by effective lumped-element circuit parameters. In an example embodiment, where A represents an minimum intended operating frequency, top PCB 120 is relatively thin, having a thickness h1<λ/20 and the liquid crystal 146 in cell region 144 has a thickness of h2<λ/20 (i.e. the gap between the opposed microstrip patches 140 and 142). The thicknesses h1 and h2 can be different from each other. In example embodiments the bottom PCB 122 has a finite thickness h3<λ/4. The narrow gap between the opposed microstrip patches 120 and 122 of each cell 106 and small spacing gaps 148 between neighboring cells 106 that results from the small periodicity provides metasurface 100 with an equivalent sheet capacitance C, and permits each cell 106 to be modeled as a parallel resonant circuit 700, 800 as shown in FIGS. 7 and 8. In this regard, FIGS. 7 and 8 illustrate equivalent circuits of the liquid crystal cell 106, where L and C1 are equivalent lump parameters as a result of the finite thickness of the bottom PCB 122.

Parallel resonant circuit 800 has a surface impedance $Z_s$ given by $$Z_s = \frac{j\omega L}{1-\omega^2 L C_v},\ C_v = C_1 \,//\, C,$$

which has a typical resonance frequency at:

$$\omega_o = \frac{1}{\sqrt{LC_v}}.$$

Where $C_v$ is the input capacitance of cell 106.

In the case of fixed values of L and $C_v$, the metasurface 100 reflects an incident wave with a phase shift of 180 degrees for frequency below the resonance frequency, and 0 degrees at the resonance frequency, and approaches −180 degrees for frequencies above the resonance frequency. Since the reflection phase may be determined by the frequency of the incoming wave with respect to the resonance frequency of the metasurface 100, the phase shift of the incoming wave can be adjusted for each individual cell 106 by varying the equivalent input capacitance $C_v$ of the unit cell 106, which is a function of the geometry of the microstrip patches 120 and 122, and thickness and dielectric constant of the liquid crystal layer 146.

Figure 9:
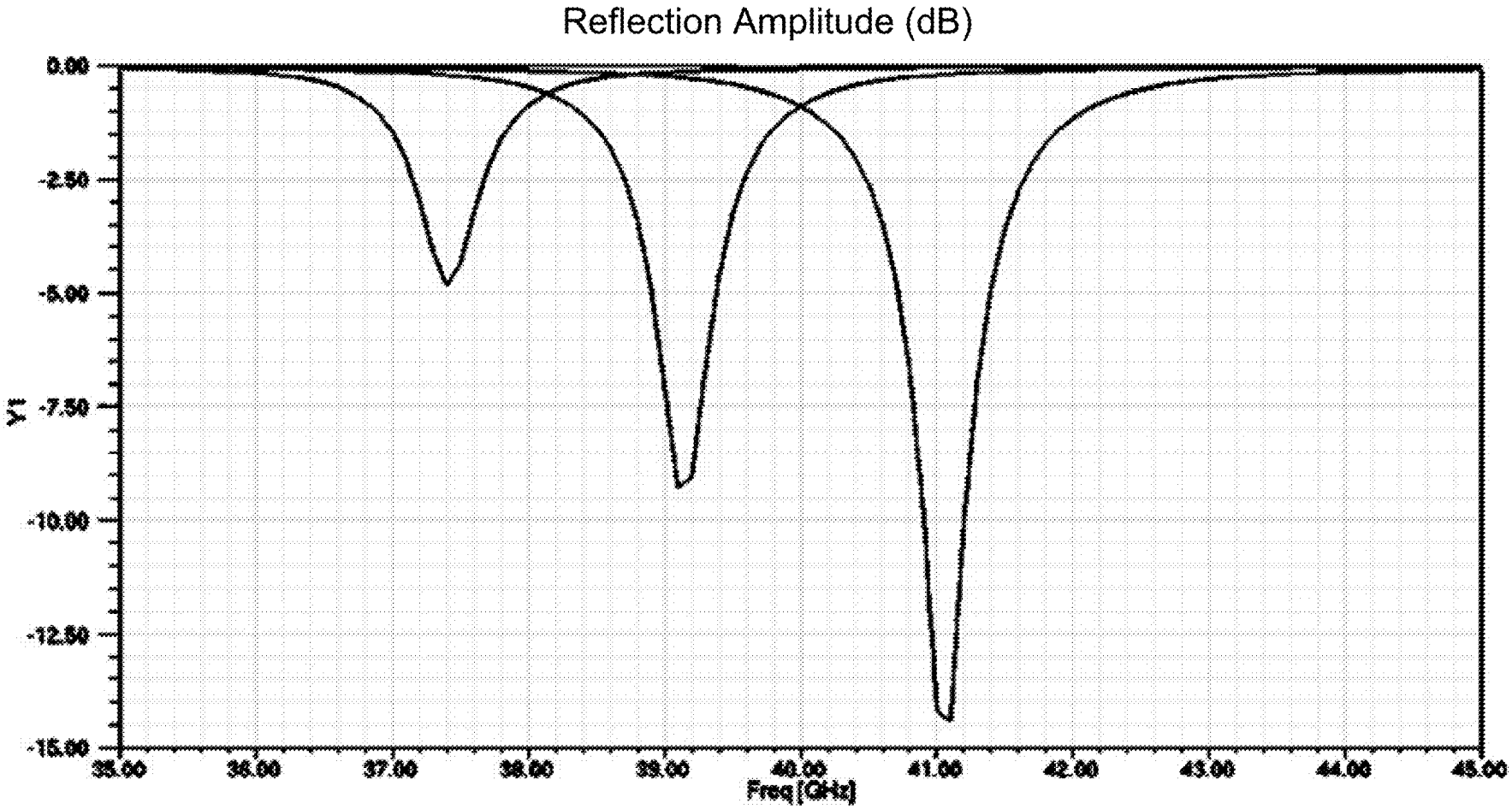
FIG. 9 is a plot of simulated reflection amplitudes of the liquid crystal tunable metasurface.
Figure 10:
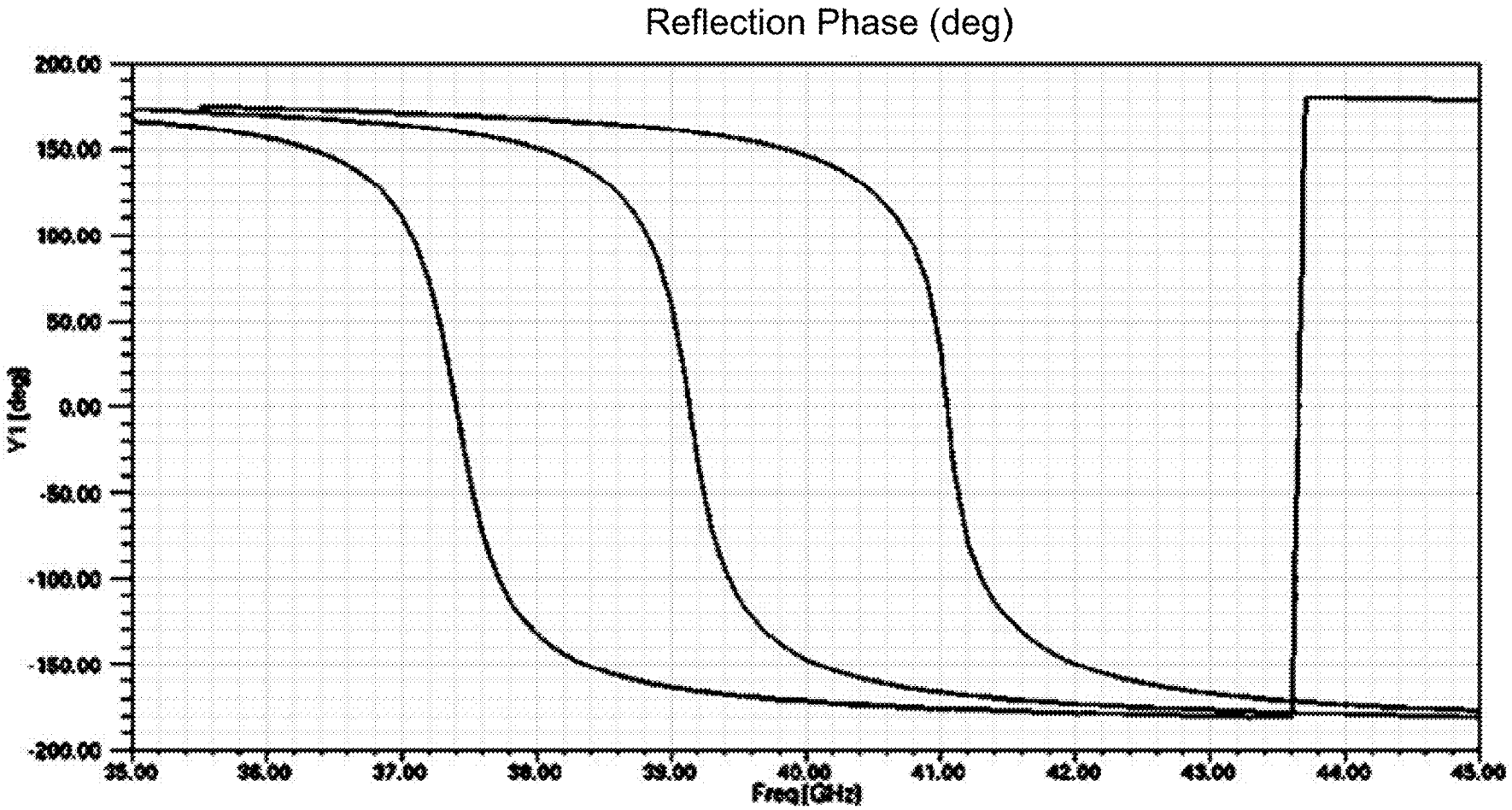
FIG. 10 is a plot of simulated reflection phases of the liquid crystal tunable metasurface.
Figure 11:
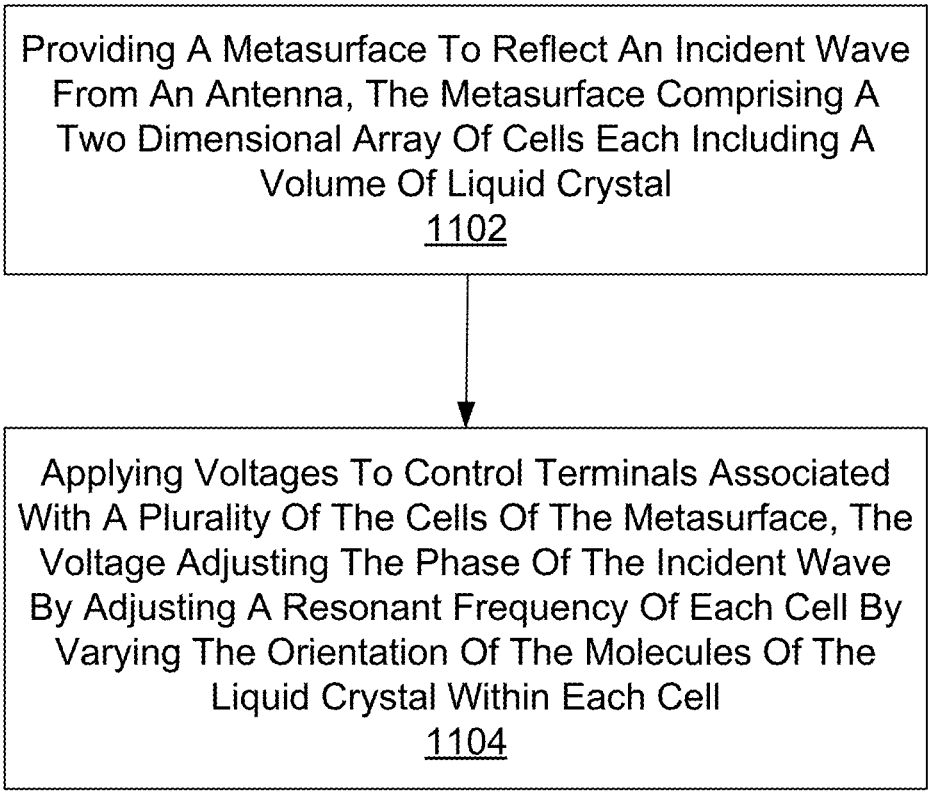
FIG. 11 is a flow diagram of a method according to example embodiments.

Therefore, the effective dielectric constant of a unit cell 106 may be independently tuned by changing electrostatic voltage between microstrip patches 120 and 122 of the unit cell 106. This change in effective dielectric constant of a unit cell 106 leads to the change in the input capacitance, $C_v$, of the cell 106. As a result, a phase differential at various locations of the metasurface 100 may be changed individually. The structure of the unit cell 106 is simulated in FIGS. 9 and 10 using a full-wave finite element EM simulator, HFSS. FIG. 9 shows the simulated reflection amplitudes and FIG. 10 shows the phases of the unit cell 106 for various effective dielectric constant values, $\varepsilon_r$, of the liquid crystal 146.

It will thus be appreciated that the reflection phase of an incident wave at the surface of the metasurface 100 can be controlled by varying the DC voltages applied to unit cells 106 such that continuous beam steering of an EM wave can be achieved by regulating DC voltage distribution to unit cells 106 across the metasurface 100.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure. For examples, although specific sizes and shapes of cells 106 are disclosed herein, other sizes and shapes may be used.

Although the example embodiments disclose individually addressable cells, other embodiments may have cells that may be addressable by row or column or in a multiplexed manner.

Although the example embodiments are described with reference to a particular orientation (e.g. upper and lower), this was simply used as a matter of convenience and ease of understanding in describing the reference figures. The metasurface may have any arbitrary orientation.

All values and sub-ranges within disclosed ranges are also disclosed. Also, while the systems, devices and processes disclosed and shown herein may comprise a specific number of elements/components, the systems, devices and assemblies could be modified to include additional or fewer of such elements/components. For example, while any of the elements/components disclosed may be referenced as being singular, the embodiments disclosed herein could be modified to include a plurality of such elements/components. The subject matter described herein intends to cover and embrace all suitable changes in technology.

The invention claimed is:

1. A metasurface for reflecting an incident wave to effect beam steering, the metasurface comprising:

first and second double sided substrates defining an intermediate region between them containing liquid crystal in a nematic phase;

the first double sided substrate having a first microstrip patch array formed on a first side thereof that faces the second substrate and a gridded wire mesh formed on a second, opposite, side thereof, the first microstrip patch array comprising a two-dimensional array of microstrip patches each being electrically connected to a respective point of the gridded wire mesh by a respective conductive path that extends through the first double sided substrate to provide a common potential; and the second double sided substrate having a second microstrip patch array formed on a side thereof that faces the first substrate, the second microstrip patch array comprising a two-dimensional array of microstrip patches each having a respective control terminal that extends through the second double sided substrate to be electrically connected with a control voltage;

the first microstrip patch array and the second microstrip patch array being aligned to form a two dimensional array of cells, each cell comprising a microstrip patch of the first microstrip patch array arranged in spaced apart opposition to a microstrip patch of the second microstrip patch array with a volume of the liquid crystal located therebetween, the control terminal to the microstrip patch of the second microstrip patch array permitting the control voltage to be applied to the cell to control a dielectric value of the volume of the liquid crystal, thereby permitting a reflection phase of the cell to be selectively tuned.

2. The metasurface of claim 1 wherein the respective conductive paths that connect the microstrip patches of the first microstrip patch array to the respective points of the gridded wire mesh each comprise a respective plated through hole that extends through the first double sided substrate.

3. The metasurface of claim 1 wherein the respective control terminals each comprise a plated through hole that extends through the second double sided substrate.

4. The metasurface of claim 1 comprising a ground plane formed on a side of the second double sided substrate that is opposite the side on which the second microstrip patch array is formed.

5. The metasurface of claim 1 wherein an insulating gap is formed on the substrates around each of the microstrip patches.

6. The metasurface of claim 1 wherein the first and second double sided substrates are formed from printed circuit boards.

7. The metasurface of claim 1 wherein a thickness of the first double sided substrate and a thickness of the intermediate region containing the liquid crystal are each less than 1/20 of an intended minimum operating wavelength of the incident wave.

8. The metasurface of claim 1 wherein the periodicity of the cells is less than 1/4 of an intended minimum operating wavelength of the incident wave.

9. A metasurface for reflecting an incident wave to effect beam steering, the metasurface comprising:

a wire mesh layer on an outer side of a first double sided substrate;

a ground plane layer generally parallel to the wire mesh layer, located on an outer side of a second double sided substrate; and a plurality of cells between the wire mesh layer and the ground plane layer, each cell comprising a first microstrip patch on an inner side of the first double sided substrate, a second microstrip patch on an inner side of the second double sided substrate and a layer of nematic liquid crystal therebetween;

for each cell, the first microstrip patch being electrically connected to the wire mesh layer by a respective conductive path that extends through the first double sided substrate, and the second microstrip patch being electrically connected to a control terminal that extends through the second double sided substrate to permit a control voltage to be applied to the cell to control a dielectric value of the liquid crystal of the cell, thereby permitting a reflection phase of the cell to be selectively tuned.

10. The metasurface according to claim 9, wherein the control terminal comprises a plated through hole that is accessible through an opening that passes through the ground plane layer.

11. The metasurface according to claim 9, wherein the microstrip patches are rectangular.

12. The metasurface according to claim 9, wherein the microstrip patches for each cell are isolated from neighboring cells by an isolating slot.

13. The metasurface according to claim 9, wherein a distance between the pair of microstrip patches is less than 1/20 of an intended minimum operating wavelength of the incident wave.

14. The metasurface according to claim 9, wherein the liquid crystal exhibits dielectric anisotropy characteristics at microwave frequencies.

15. A method of beam steering, the method comprises:

providing a metasurface to reflect an incident wave from an antenna, the metasurface comprising a two dimensional array of cells each including a volume of liquid crystal;

wherein providing the metasurface comprises:

providing a first double sided substrate with a first two dimensional array of microstrip patches formed on one side of the substrate and a gridded wire mesh formed on an opposite side of the substrate, each of the microstrip patches of the first two dimensional array being electrically connected to a respective point on the gridded wire mesh by a conductive path extending through the first double sided substrate to provide a common potential;

providing a second double sided substrate having a second two dimensional array of microstrip patches formed on one side of the substrate, each of the microstrip patches of the second two dimensional array having a respective control terminal extending through the second double sided substrate;

arranging the first and the second double sided substrate with a layer of nematic state liquid crystal therebetween such that each microstrip patch of the first two dimensional array aligns with a respective microstrip patch of the second two dimensional array to form the two dimensional array of cells;

applying voltages to the control terminals associated with a plurality of the cells of the metasurface, the voltage adjusting the phase of the incident wave by adjusting a resonant frequency of each cell by varying the orientation of the molecules of the liquid crystal within each cell.

16. The method of claim 15 comprising forming the first and second two dimensional arrays of microstrip patches and the wire mesh by etching conductive layers on the first and second double sided substrate.

* * * * *